United States Patent [19]

Smith

[11] 4,415,283

[45] Nov. 15, 1983

[54] SHORTHAND MACHINE HAVING ACTIVE TACTILE FEEDBACK

[75] Inventor: Michael A. Smith, Slidell, La.

[73] Assignee: Baron Data Systems, San Leandro, Calif.

[21] Appl. No.: 402,401

[22] Filed: Jul. 27, 1982

[51] Int. Cl.[3] ..... B41J 3/26

[52] U.S. Cl. ..... 400/94

[58] Field of Search ..... 400/91, 92, 93, 94, 400/482, 439

[56] References Cited

U.S. PATENT DOCUMENTS

| | | | |
|---|---|---|---|
| 2,319,273 | 5/1943 | Sterling | 400/93 |
| 2,387,330 | 10/1945 | Johnson . | |
| 2,390,414 | 12/1945 | Ayres et al. | 400/94 |
| 2,408,754 | 8/1946 | Bush . | |
| 2,593,371 | 4/1952 | Watson . | |
| 2,855,082 | 10/1958 | Katz | 400/94 |
| 2,877,741 | 3/1959 | Wilson . | |
| 2,912,090 | 11/1959 | Holmes, Jr. | 400/91 X |
| 3,017,980 | 1/1962 | D'Onofrio . | |
| 3,557,927 | 1/1971 | Wright . | |
| 3,618,738 | 11/1971 | Boyatt . | |
| 3,892,915 | 7/1975 | Budworth . | |
| 3,964,062 | 6/1976 | Flagg . | |
| 4,181,444 | 1/1980 | Heider . | |
| 4,205,351 | 5/1980 | Michals | 400/94 X |
| 4,247,208 | 1/1981 | Fulkerson et al. | 400/194 |
| 4,363,558 | 12/1982 | Michals et al. | 400/94 |

OTHER PUBLICATIONS

Service Manual and Parts List for the Stenograph Shorthand Machine, Stenograph Corporation, Copyright 1980 by Stenograph Corporation.

*Primary Examiner*—Clifford D. Crowder
*Assistant Examiner*—Charles A. Pearson
*Attorney, Agent, or Firm*—Beveridge, De Grandi & Kline

[57] ABSTRACT

A shorthand machine having active tactile feedback to the keyboard, providing the operator with a keyboard response permitting the operator to sense return of the keys sufficiently toward their rest position to permit initiation of the next key stroke without stacking of notes. A solenoid or other actuator is energized following initiation of the return of the keys to their rest position after the printing of each word and urges the universal bar toward its rest position, thereby urging the keys toward their rest position. The operator senses this pressure on the keys and thus can tell when the keys are returned sufficiently toward the rest position to permit initiation of the next stroke. As a consequence the operator's timing is improved, and he can write faster and for a longer time without stacking notes and with less fatigue.

9 Claims, 5 Drawing Figures

FIG. 1
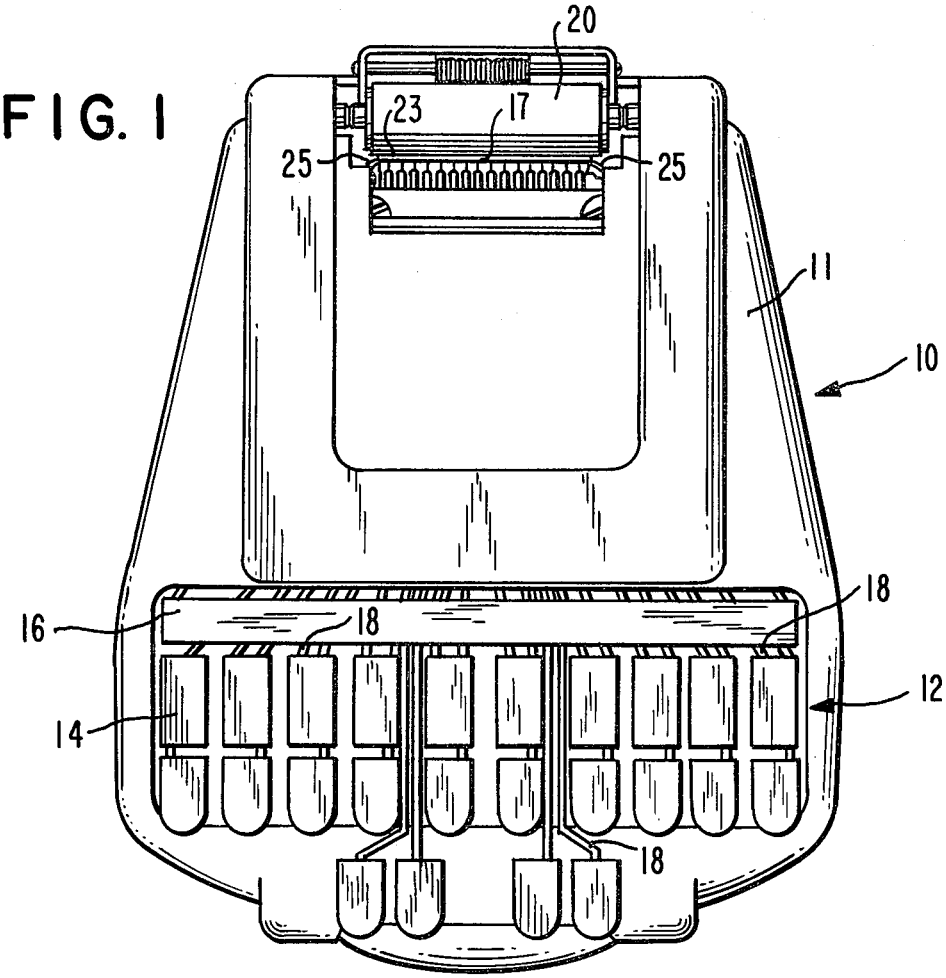
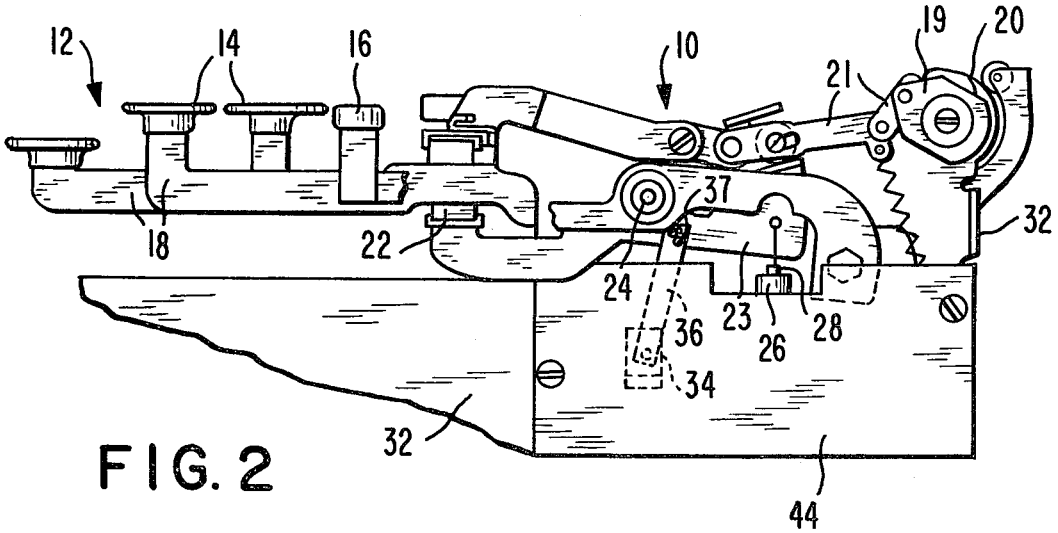
FIG. 2

SHORTHAND MACHINE HAVING ACTIVE TACTILE FEEDBACK

BACKGROUND OF THE INVENTION

The present invention pertains to shorthand machines. More particularly, the present invention pertains to a shorthand machine having active tactile feedback to the keyboard, providing the operator with a keyboard response permitting the operator to sense that the keys have moved toward their rest position a sufficient amount to permit paper advance while allowing maximum writing speed.

Shorthand machines are frequently utilized to record oral proceedings, for example at business conferences, court hearings, and other situations where it is desired to have a written record of the oral preceeding. Wholly mechanical shorthand machines are widely utilized for this purpose and generally include a large number of keys, each coupled by a keystem to a type bar or print hammer having an alphabetical character thereon. Some of the print hammers also have a numerical character, and the machine is provided with a numeral bar which can be depressed to change from an alphabetical mode to a numerical mode. When a key is depressed, its associated print hammer is moved to impact against an inked ribbon supported adjacent a platen over which a paper tape passes, causing the printing of the associated alphabetical or numerical character on the paper tape. Numerals and shorthand representations of words can thus be imprinted on the paper tape by the operator to provide a written record of oral proceedings. Such a mechanical shorthand machine is shown, for example, in U.S. Pat. No. 2,319,273, the disclosure of which is incorporated herein by reference.

Some shorthand machines are additionally equipped with a magnetic recording medium and circuitry to record on that medium encoded representations of the alphabetical characters so that as the operator actuates the keys to cause the imprinting of the written record on the paper tape, a magnetic record is also made on the magnetic recording medium. This magnetic recording medium might then be utilized as an input to a transcribing device. Such machines are shown, for example, in U.S. Pat. No. 3,557,927 and in U.S. Pat. No. 4,205,351, the disclosures of which are incorporated herein by reference.

In shorthand machines of either of these types, each key is provided with a spring which retains the key in a rest position during time intervals that the key is not being actuated by the operator. In addition, there generally is a bar, termed a universal bar, extending beneath all of the keystems and retained by a spring in a rest position adjacent the positions when keys are at rest. Accordingly, as the keys are depressed, the keystems depress the universal bar. Thus, when the operator depresses the keys, the key movement is opposed by both the resistance of the keystem springs and the resistance of the universal bar spring. When the operator then releases the keys, the springs return the keys and the universal bar to their rest position.

Nevertheless, a keyboard of this type provides little, if any, response to the operator during return of the keys to the rest position since the action of the keys is merely to follow the operator's fingers back to that rest position. In recording a single word the operator might depress several of the keys in order to create the phonetic symbol of that word. It is not essential that each of the several keys be depressed at exactly the same time or at exactly the same rate, since the paper tape is not moving at the time of printing and since the recording circuitry generally includes components which inhibit recording until all keys are either in the rest position or fully depressed. Likewise, it often happens that as the keys are returning to their rest position, they do not move in unison, some reaching the rest position before others. It is often necessary for the operator to record information at a very high rate of speed, for example when recording a statement made by someone talking rapidly. During such high speed writing, it sometimes happens that the operator does not allow every key to return sufficiently toward its rest position at the completion of the writing of one word before commencing the downward stroke for the next word. The actuation of the keys not only causes the imprinting of the characters on the paper tape, and the recording of the characters on the magnetic recording medium on those shorthand machines so equipped, but also it initials actuation of the platen to advance the paper tape. If the operator does not allow all of the keys that have been depressed for one word to return a sufficient distance before initiating depression of the keys for the next word, the paper tape might not advance the full amount desired. This results in recording of one word partially or fully on top of a previous word, known as stacking of the notes. Likewise, stacking can occur in the recording of the characters on magnetic recording medium.

Shorthand machines having certain components electrically powered are known. By way of examples, U.S. Pat. No. 2,855,082 shows a shorthand machine in which the print hammers are actuated by solenoids in response to movement of the keys, and U.S. Pat. No. 4,247,208 shows a shorthand machine in which the platen is rotated by a solenoid or motor. Even these machines, however, do not provide tactile feedback to the operator, and so there is no indication to the operator when the keys are sufficiently returned toward their rest position.

SUMMARY OF THE INVENTION

The present invention is a shorthand machine having active tactile feedback and thereby providing improved performance, particularly from the point of view of the operator. In accordance with the present invention the shorthand machine is provided with electrical actuation means responsive to initiation of the return of the keys to their rest position for urging the universal bar toward its rest position. As the universal bar is thus urged toward its rest position, the keystems, and thus the keys, are likewise urged toward their rest position. Accordingly, the operator senses this pressure urging the return of the keys toward the rest position, and when that pressure ends the operator knows that the keys are sufficiently returned that a new character can be stroked or written without stacking of notes. In a preferred embodiment of the present invention, the electrical actuation means is a solenoid which is actuated on commencement of the return of the keys to the rest position. When the operator commences to release the keys following the printing of a word, the solenoid is triggered to apply pressure to the universal bar, urging the universal bar in the direction in which it already is moving. This feedback is felt by the operator as a push toward restoration of the keys to the rest position. Preferably, the point along the path of key restoration at which the pressure is first applied and the length of time that the solenoid applies pressure are each controllable. Consequently, the response or feel of the machine can be adjusted to provide a very short push or "bump" giving the operator a positive indication of the point in the key return of each keyboard stroke at which it is all right to commence the next stroke. Therefore, once the operator is accustomed to the tactile feedback system, he knows, perhaps on a subconscious level, that he must continue to release pressure from the keys until he receives the proper feeling or bump in his fingertips, at which time he can commence the stroke for the next word to be recorded. This helps to eliminate stacking of notes, both on the paper tape and on the magnetic recording medium, while permitting the operator to write at his maximum speed.

The tactile feedback system of the present invention offers the additional advantage of improved touch or feel of the keyboard. The active tactile feedback system tends to propel the operator's fingers from each stroke into the next stroke during high speed writing. This increases the operator's sense of timing, allowing him to write faster with less effort. Consequently, the operator can write more accurately for a longer period of time.

In order to initiate operation of the solenoid, an optical switch can be utilized, including a vane which moves with the universal bar. Alternatively, in shorthand machines capable of recording indicia on a magnetic recording medium, a signal from the recording circuitry can be utilized to initiate operation of the solenoid.

BRIEF DESCRIPTION OF THE DRAWINGS

These and other aspects and advantages of the present invention are more apparent in the following detailed description and claims, particularly when considered in conjunction with the accompanying drawings in which like parts bear like reference numerals. In the drawings:

FIG. 1 is a top plan view of a shorthand machine in accordance with the present invention;

FIG. 2 is a fragmentary side elevational view of components of a shorthand machine, in accordance with one preferred embodiment of the present invention when removed from the casing;

DETAILED DESCRIPTION OF THE INVENTION

Figure 3:
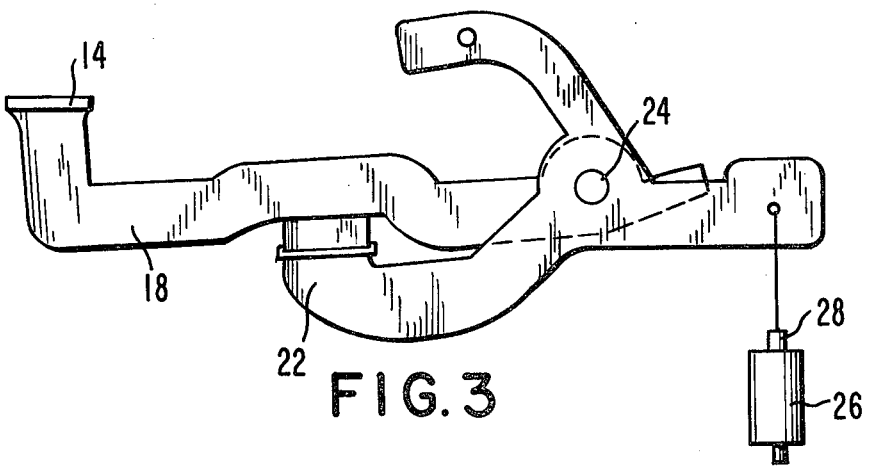
FIGS. 3 and 4 are enlarged detailed views depicting alternative embodiments of certain of the components within a shorthand machine in accordance with the present invention.

FIG. 1 is a top plan view of a shorthand machine 10, and FIG. 2 depicts internal components of the shorthand machine 10. Shorthand machine 10 is generally housed within a casing or shell 11 to protect the machine and to improve its appearance. Shorthand machine 10 includes a keyboard 12 having a plurality of keys 14, usually 22 separately movable keys. Each key 14 is associated with an alphabetical character or letter. Certain of the keys 14 are also associated with a numerical character or number. A numeral bar 16 is also provided, and when numeral bar 16 is depressed it causes those keys associated with both a letter and a number to shift from the letter mode to the number mode for printing of numerals.

Each of the keys 14 is provided with a keystem 18 which couples the key to the associated print hammer 17. Accordingly, as each key 14 is depressed, its associated print hammer 17 impacts against an inked ribbon 23 which is positioned by support members 25 adjacent platen 20 to bring the inked ribbon into contact with the paper tape which passes over platen 20, causing printing of the associated character on the paper tape. Additionally, when each key is depressed or released it actuates a ribbon advancement mechanism to cause the linked ribbon to incrementally advance. Depression or release of the key also actuates an appropriate mechanism, such as clutch 19 and clutch linkage 21, thereby advancing the paper tape for the next word to be printed.

Universal bar 22 extends beneath each keystem 18 and, in the rest position of the keys, universal bar 22 contacts the under surface of each keystem 18. As a consequence, when one or more of the keys 14 is depressed, universal bar 22 is pivoted about pivot pin 24, raising the end 23 of universal bar 22 remote from keystems 18 (to the right of pivot pin 24 in FIG. 2).

In the embodiment of the present invention depicted in FIGS. 2 and 3, solenoid 26 is attached to frame 32 of shorthand machine 10 and has its armature 28 coupled to remote end 23 of universal bar 22. Consequently, with solenoid 26 deenergized, depression of one or more of the keys 14 causes remote end 23 of universal bar 22 to move upwardly, pulling armature 28 outwardly from solenoid 26. Upon initiation of the return of the keys to their rest position, solenoid 26 is powered or actuated, and armature 28 returns to its position within the solenoid, pulling remote end 23 of the universal bar downwardly, and so pushing keystems 18 upwardly toward their rest position.

Figure 4:
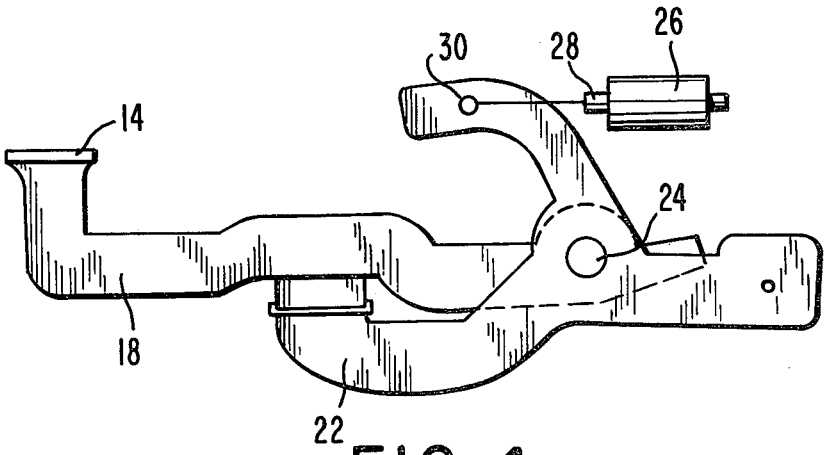

FIG. 4 depicts an alternative embodiment in which armature 28 of solenoid 26 is connected to a different point 30 on universal bar 22. Thus it is seen that the restoration force can be applied in various manners.

In the embodiment of the present invention depicted in FIG. 2, an optical switch 34 is mounted on frame 32 of shorthand machine 10, and a leaf member or vane 36 is attached by bolts 37 which mate with threaded openings in universal bar 22 so that with keys 14 and universal bar 22 in their rest positions, vane 36 interrupts the light path of optical switch 34. As universal bar 22 moves in response to depression of a key 14, vane 36 moves out of the light path of optical switch 34. When the operator then commences to release the depressed key or keys 14, the associated springs on the keystems 18 and on universal bar 22 commence to return the keys to the rest position. Vane 36 is positioned so that at a selected point in this movement, the light path of optical switch 34 is again broken, and as a consequence the optical switch provides an output, which results in actuation of solenoid 26. Bolts 37 and their threaded openings in universal bar 22 preferably permit slight adjustment of the position of vane 36 so that the point in the return of keys 14 at which the solenoid is actuated can be adjusted. If preferred, optical switch 34 and vane 36 can be mounted so that in the rest positions of keys 14 and universal bar 22 the light path of the optical switch is unbroken, and when universal bar 22 moves, the vane breaks the light path. Then upon initiation of the return of universal bar 22 to its rest position the light path is restored to actuate the solenoid. In shorthand machines which include a magnetic recording medium, an output signal from the magnetic recording circuitry following completion of the recording (and upon sufficient return of universal bar 22) might be utilized in place of the output signal from optical switch 34.

Figure 5:
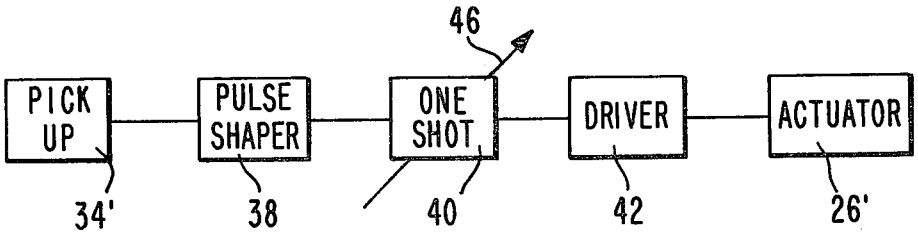
FIG. 5 is a block diagram of an electrical circuit suitable for use in the shorthand machine of the present invention.

FIG. 5 is a block diagram of circuitry suitable for coupling solenoid 26 to optical switch 34 of FIG. 2 or to the magnetic recording circuitry. As shown in FIG. 5, pickup 34', which might be the optical switch 34 in FIG. 2 or which might be within the magnetic recording circuitry of a shorthand machine so equipped, provides an output to pulse shaper 38. The output of pulse shaper 38 triggers monostable multivibrator or one shot 40, the output of which is applied through power amplifier or driver 42 to actuator 26' which in the embodiment of FIGS. 2 through 4 is solenoid 26. The electronic circuitry of FIG. 4 can conveniently be mounted on printed circuit board 44 which is attached to frame 32 of shorthand machine 10.

The time constant within one-shot 40 can be adjusted to provide power to actuator 26' for the time interval required to cause the active tactile feedback to terminate at the desired point in the return of keys 14 to the rest position. While this could be preset, a variable resistor could be included in the circuitry of one-shot 40 with a control 46 to permit the shorthand machine operator to vary the time interval to suit his preferences.

Although the present invention has been described with reference to preferred embodiments, modifications and rearrangements could be made, and still the result would be within the scope of the invention.

What is claimed is:

1. A shorthand machine comprising a platen adapted for supporting paper; support means adapted for supporting an inked ribbon adjacent said platen; a plurality of print hammers; a plurality of keys, each key having a keystem mechanically coupling its associated key to an associated print hammer, each key normally assuming a rest position and movable to an actuated position to cause its associated print hammer to impact against an inked ribbon support by said support means to bring the linked ribbon into contact with paper supported on said platen to print a character on such paper; a universal bar extending beneath said plurality of keystems, said universal bar normally assuming a reset position adjacent said keystems when said keys are in their rest position and responsive to movement of said keys toward the actuated position to move to a second position; means to enable the machine operator to sense when the previously actuated keys are sufficiently returned toward the key rest position so that a succeeding key actuation will result in printing of characters properly positioned relative to the characters printed in response to the previous key actuation, said means to enable including electrically actuated means responsive to initiation of the return of said keys from the actuated position to the key rest position for moving said universal bar toward said universal bar rest position, thereby urging said keys to return to said key rest position, termination of the actuation of said electrically actuated means resulting in a sensation indicating to the machine operator that another key stroke may be made; and means responsive to movement of said universal bar toward one of the second position and the universal bar rest position for rotating said platen to feed paper over said platen.

2. A shorthand machine as claimed in claim 1 in which said electrical actuation means comprises generating means for generating a signal following initiation of the return of said keys to the key rest position; an electrical actuator connected to said universal bar; and circuit means coupling said generating means to said electrical actuator for energizing said electrical actuator in response to said generating means signal.

3. A shorthand machine as claimed in claim 2 in which said generating means is adjustable to adjust the point in the return of said keys to the key rest position at which said generating means generates a signal.

4. A shorthand machine as claimed in claim 2 or 3 in which said generating means comprises an optical switch.

5. A shorthand machine as claimed in claim 2 or 3 in which said electrically actuated means comprises a solenoid.

6. A shorthand machine as claimed in claim 5 in which said circuit means includes pulse forming means responsive to said generating means signal for applying an electrical pulse to said solenoid.

7. A shorthand machine as claimed in claim 6 in which said pulse forming means includes means for controlling the duration of the pulse.

8. A shorthand machine as claimed in claim 2 or 3 in which said circuit means includes pulse forming means responsive to said generating means signal for applying an electrical pulse to said actuator.

9. A shorthand machine as claimed in claim 8 in which said pulse forming means includes means for controlling the duration of the pulse.

* * * * *